US005657878A

United States Patent [19]

Austin

[11] Patent Number: 5,657,878

[45] Date of Patent: Aug. 19, 1997

[54] ADJUSTABLE HEIGHT MECHANISM FOR A DISHWASHER RACK

[75] Inventor: Ronald M. Austin, Westchester, Ill.

[73] Assignee: Illinois Tool Works Inc., Glenview, Ill.

[21] Appl. No.: 501,728

[22] Filed: Jul. 12, 1995

[51] Int. Cl.[6] ..... A47F 5/00

[52] U.S. Cl. ..... 211/41.8; 211/208; 248/408; 312/334.4

[58] Field of Search ..... 211/41, 181, 207, 211/208; 248/408, 423, 297.31; 312/334.4

[56] References Cited

U.S. PATENT DOCUMENTS

| | | | |
|---|---|---|---|
| 493,111 | 3/1893 | Parsons | 248/409 |
| 2,124,755 | 7/1938 | Simpson et al. | 248/423 X |
| 3,137,512 | 6/1964 | Carpezzi | 248/408 X |
| 4,036,525 | 7/1977 | Howk | 248/408 X |
| 4,577,837 | 3/1986 | Berg et al. | 248/408 X |
| 5,409,309 | 4/1995 | Giddings et al. | 312/334.4 X |
| 5,474,378 | 12/1995 | Smith et al. | 312/334.4 |

*Primary Examiner*—Robert W. Gibson, Jr.
*Attorney, Agent, or Firm*—Schwartz & Weinrieb

[57] ABSTRACT

An adjustable position mechanism is provided for selectively varying the position of a first member relative to a second member. This adjustable position mechanism includes a support, and an elongated arm projecting from the support and having a plurality of locking elements in a linearly spaced array for defining a plurality of increments of position and a guide. An actuator has cooperating locking elements of complementary form to the locking elements of the arm, a moveable element for selectively moving the cooperating locking elements into and out of engagement with the locking elements of the arm, and a cooperating guide engageable with the guide of the arm for guiding reciprocal longitudinal movement of the actuator relative to the arm. A housing is coupled with the first member and with the actuator for operatively coupling the first member to move reciprocally with the actuator relative to the arm.

26 Claims, 5 Drawing Sheets

ADJUSTABLE HEIGHT MECHANISM FOR A DISHWASHER RACK

FIELD OF THE INVENTION

The present invention is directed generally to an adjustable position apparatus or mechanism for adjusting the position of a first member relative to a second member, and more particularly to an adjustable position mechanism for adjusting the height of a dishwasher rack.

BACKGROUND OF THE INVENTION

Present adjustable height mechanisms for dishwasher racks generally use a screw type of adjustment which can be somewhat slow and cumbersome for larger adjustments in height. Moreover, the adjustable height assembly must be physically fastened or attached by screws or like fasteners to the rack, which takes some time and care in installation. Also, present mechanisms require the use of two different assemblies, one configured for each side of the rack. Thus, installers are required to maintain a supply of both left-hand and right-hand adjustable height assemblies and properly select and install one of each on each dishwasher rack in the assembly process. Moreover, this requires that both types of assemblies and their constituent parts be inventoried and handled separately. This may also require separate inventorying and handling of two sets of subassembly parts for the respective height adjustment assemblies and the proper assembly of each prior to assembly of the completed adjustment mechanisms with respective right-hand and left-hand sides of the dishwasher rack.

The present invention concerns an adjustable height apparatus for a dishwasher rack which offers a relatively simple and easy to use height adjustment, and is relatively simple to install during rack and dishwasher assembly. Preferably, the adjustable height apparatus of the invention is of a symmetrical design such that the same apparatus may be installed upon both left-hand and right-hand sides of the rack, thus further increasing the ease of installation and simplifying the inventory and parts handling process.

OBJECTS AND SUMMARY OF THE INVENTION

Accordingly, it is a general object of the invention to provide a novel and improved adjustable position apparatus.

A more particular object is to provide an adjustable height apparatus for a dishwasher rack which overcomes the above-noted shortcomings of the prior art and provides the above-noted advantages.

Briefly, and in accordance with these objects an adjustable position apparatus for selectively varying the position of a first member relative to a second member comprises support means for supporting the apparatus relative to the second member; elongated arm means projecting from said support means and having a plurality of locking means in a linearly spaced array thereupon for defining a plurality of increments of position, and guide means; actuator means having cooperating locking means of complementary form to said locking means of said arm means, moveable means for selectively moving said cooperating locking means into and out of engagement with the locking means, and cooperating guide means engageable with said guide means for guiding reciprocal longitudinal movement of said actuator means relative to said arm means; and housing means coupled with said first member and with said actuator means for operatively coupling said first member to move reciprocally with said actuator means relative to said arm means.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements throughout the several views and in which

DETAILED DESCRIPTION OF THE ILLUSTRATED EMBODIMENT

Figure 1:
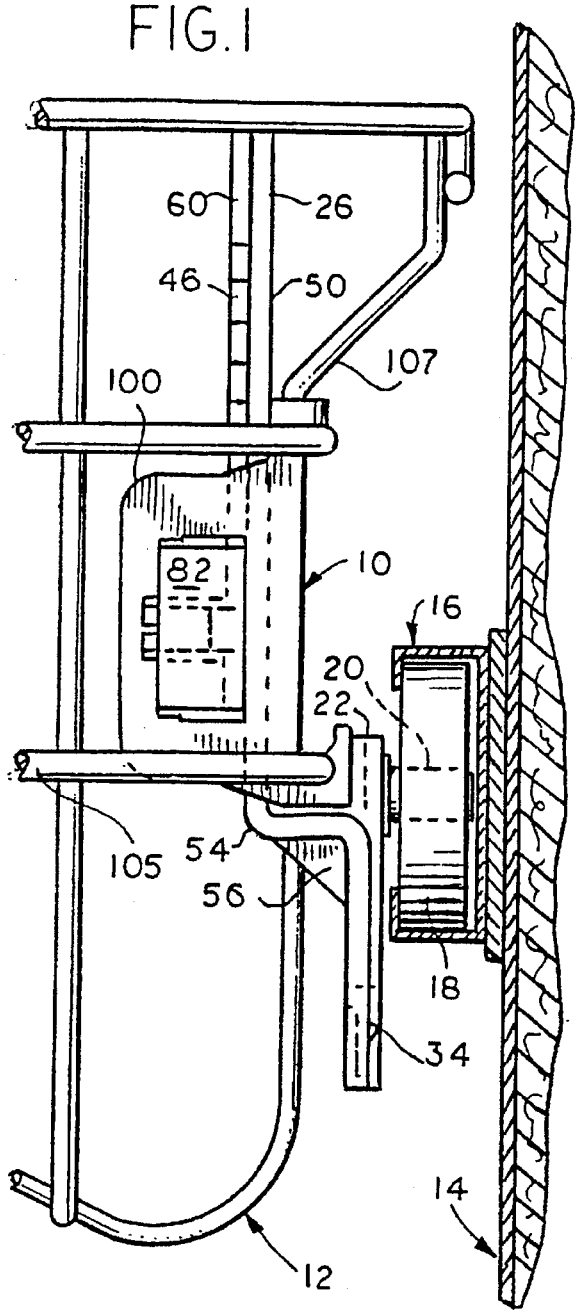
FIG. 1 is an end elevation of an adjustable height apparatus in accordance with the invention in use as a height adjusting mechanism for a dishwasher rack.
Figure 2:
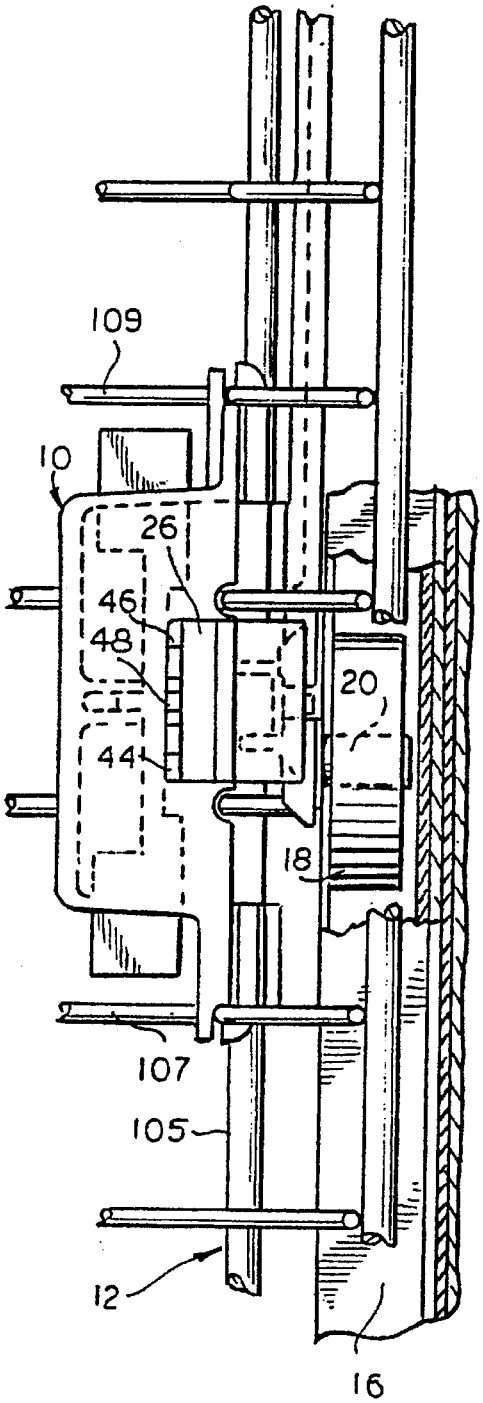
FIG. 2 is a top plan view of the apparatus of FIG. 1.

Referring now to the drawings in initially to FIGS. 1–4, an adjustable position apparatus or mechanism in accordance with the invention is designated generally by the reference numeral 10. In the embodiment illustrated, this adjustable position mechanism is provided for adjusting the height of a dishwasher rack 12. The dishwasher rack 12 is mounted by means of the adjustable position apparatus 10, as will be more fully described later herein for slidable movement into and out of a dishwasher, a portion of one inside wall of which is designated here by reference numeral 14. While this slidable mounting may take other forms, it is here represented as a track 16 of the dishwasher which is mounted to the wall 14 and in turn mounts a wheel or roller 18. This roller 18 is in turn rotatably mounted to a hub or shaft 20 which projects from and forms a part of a support member 22 of the adjustable position apparatus of the invention. This support member 22 and its hubs 20 are also shown in FIG. 5.

Figure 5:
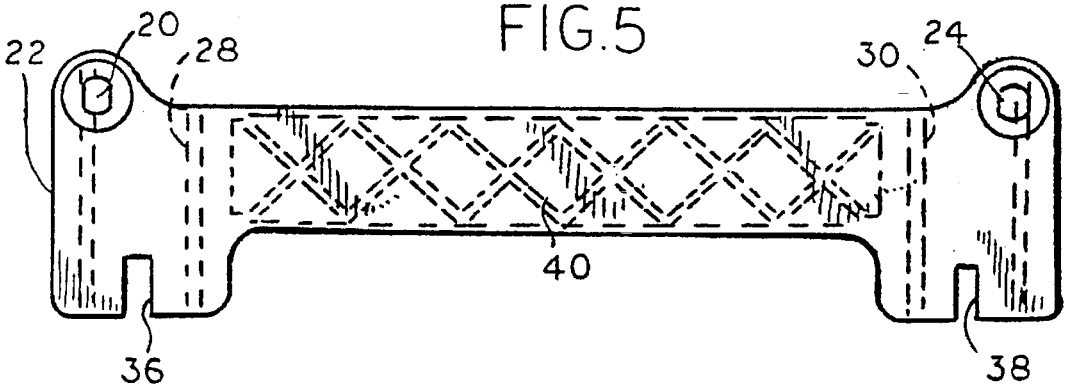
FIG. 5 is a side elevation of a support member of the apparatus of the invention.
Figure 6:
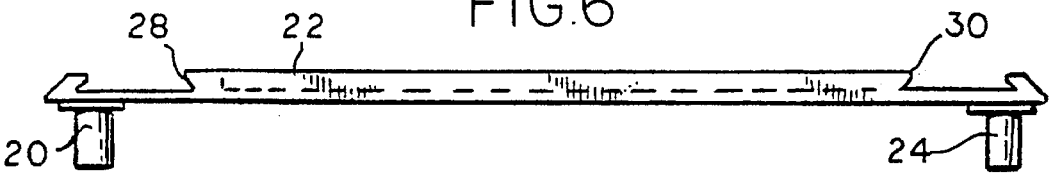
FIG. 6 is a top plan view of the support member of FIG. 5.

The support member 22, as shown in FIGS. 5 and 6, is an elongate member which supports the hub 20 and a second similar hub 24 generally at opposite ends thereof. This accommodates mounting of a wheel 18 and a second similar wheel (not shown) for engaging the track 16 at spaced apart locations. The support member 22 thus supports the remaining elements of the adjustable position apparatus 10 relative to the wall 14 of the dishwasher, such that the height of the rack 12 is adjustable relative to this wall 14. The support member 22 may also be molded with a plurality of crossed rib members 40 along its length intermediate the respective dovetail slots 28 and 30 for additional strength.

Figure 8:
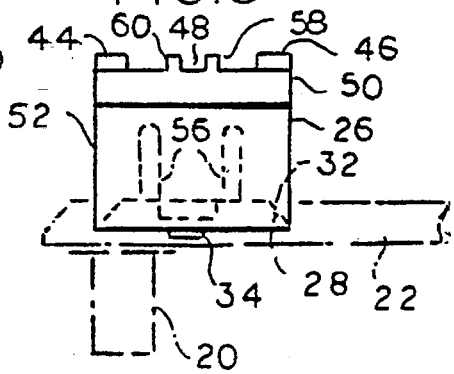
FIG. 8 is a top plan view of the arm member of FIG. 7.
Figure 10:
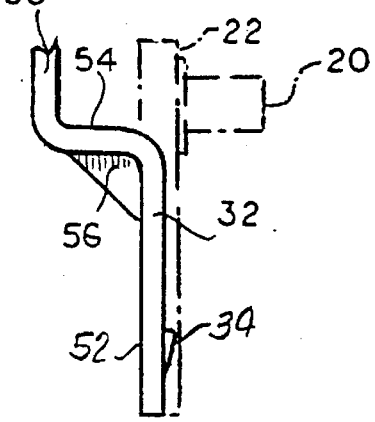
FIG. 10 is an enlarged partial elevation similar to FIG. 7 and showing further details of the engagement between the arm member and the support member.

An elongated arm member 26 projects from and is supported by the support member 22. When the support member 22 is mounted relative to track 16 as illustrated herein, the arm member 26 projects generally in a vertical upward direction therefrom. Referring also to FIGS. 6, 8 and 10, the arm 26 engages the support member 22 at one of two dovetail slots 28, 30 at either end of the support member 22. The arm member 26 has a reciprocal or complementary dovetail feature 32 at its lower end which interfits with one of these dovetail slots 28, 30. Moreover, the arm 26 includes a resilient locking tab member 34 which releaseably interlocks with one of a pair of complementary formed slots 36, 38 which are formed within either end of the support member 22. Thus, the support member 22 is symmetrical, such that it may be mounted to either the right-hand or left-hand side of the dishwasher rack 14 for cooperating with a track such as the track 16 upon either side thereof. Similarly, the arm member 26 is symmetrically formed such that it may be mounted to either side of the rack 12. Therefore, different types of arm members 26 and support members 22 are not needed for respective right-hand and left-hand height adjustments relative to the rack 12.

Figure 7:
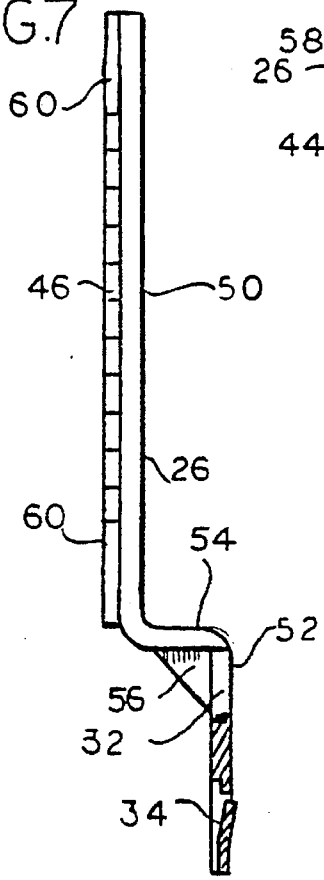
FIG. 7 is a side elevation of an arm member of the apparatus of the invention.
Figure 9:
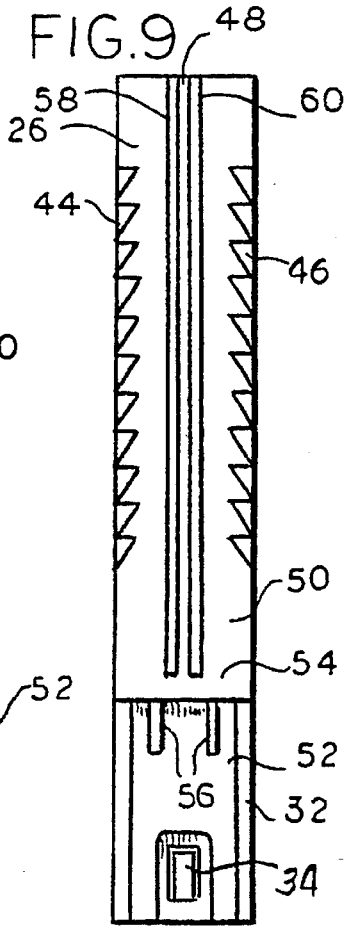
FIG. 9 is an end elevation of the arm member of FIGS. 7 and 8.

Referring also to FIGS. 7–9, the arm also has a plurality of locking means or elements 44, 46 which are arranged in a linear, and as here illustrated, vertically spaced array extending or projecting above the support member 22. In the illustrated embodiment these locking elements 44, 46 comprise two vertical arrays of ratchet teeth which are parallel and spaced apart and mutually inwardly facing. Intermediate the ratchet teeth 44, 46 an elongate guide channel 48 is formed between two parallel ribs 58, 60 which extend along the length of the arm 26. Thus, the arm 26 will be seen to comprise an elongate upper portion 50 on which the ratchet teeth 44, 46 and channel 48 are carried and a lower portion 52 upon which the reciprocal dovetail feature 32 and locking tab 34 are carried. These two portions 50 and 52 are offset somewhat and joined by a right angle connecting portion 54. This connection may further be strengthened or stiffened by the addition of one or more diagonal rib members 56.

Figure 11:
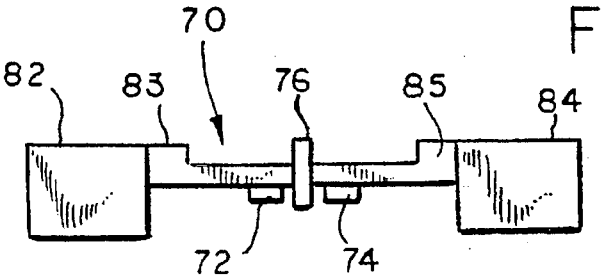
FIG. 11 is a top plan view of an actuator member of the apparatus of the invention.
Figure 12:
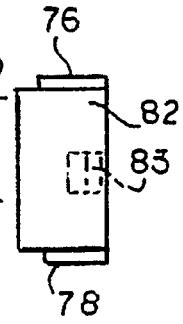
FIG. 12 is an end view of the actuator member.
Figure 4:
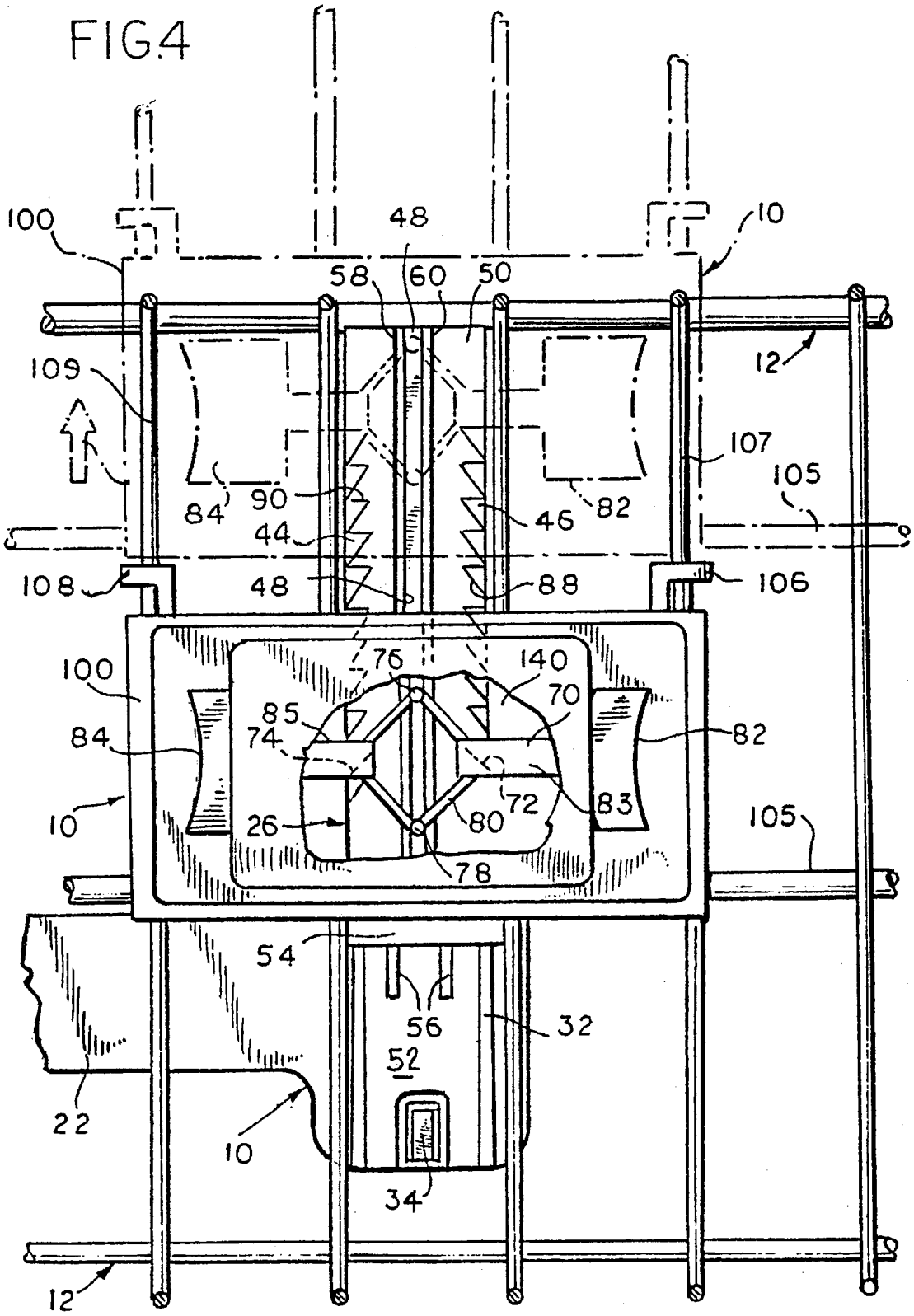
FIG. 4 is a side elevation, partially broken away, and taken from the side opposite that shown in FIG. 3.

As also shown in FIGS. 11 and 12, an actuator member 70 has a pair of cooperating locking means in the form of ratchet teeth 72, 74 which are of complementary form with the ratchet teeth 44, 46 of the arm member 26. These ratchet teeth 72 and 74 are located so as to move in unison with actuating buttons 82 and 84. In the illustrated embodiment, the ratchet teeth 72 and 74 are located on inwardly extending stem portions 83, 85 of the respective buttons 82 and 84. These stem portions 83, 85 are configured for slidable engagement with internal surfaces of a housing 100 which will be described hereinbelow.

A cooperating guide means in the form of a projecting guide pin 76 is engageable with the guide channel 48 of the arm member 26 for retaining the actuator member 70 and its ratchet teeth 72, 74 in alignment with the upper portion 50 of the arm member 26 and its ratchet teeth 44, 46. In the illustrated embodiment, a pair of similar guide pins 76, 78 are formed at respective apices of a scissors spring structure. 80 which is formed intermediate and joins the pair of oppositely outwardly extending, manually engageable actuator buttons 82, 84.

Figure 3:
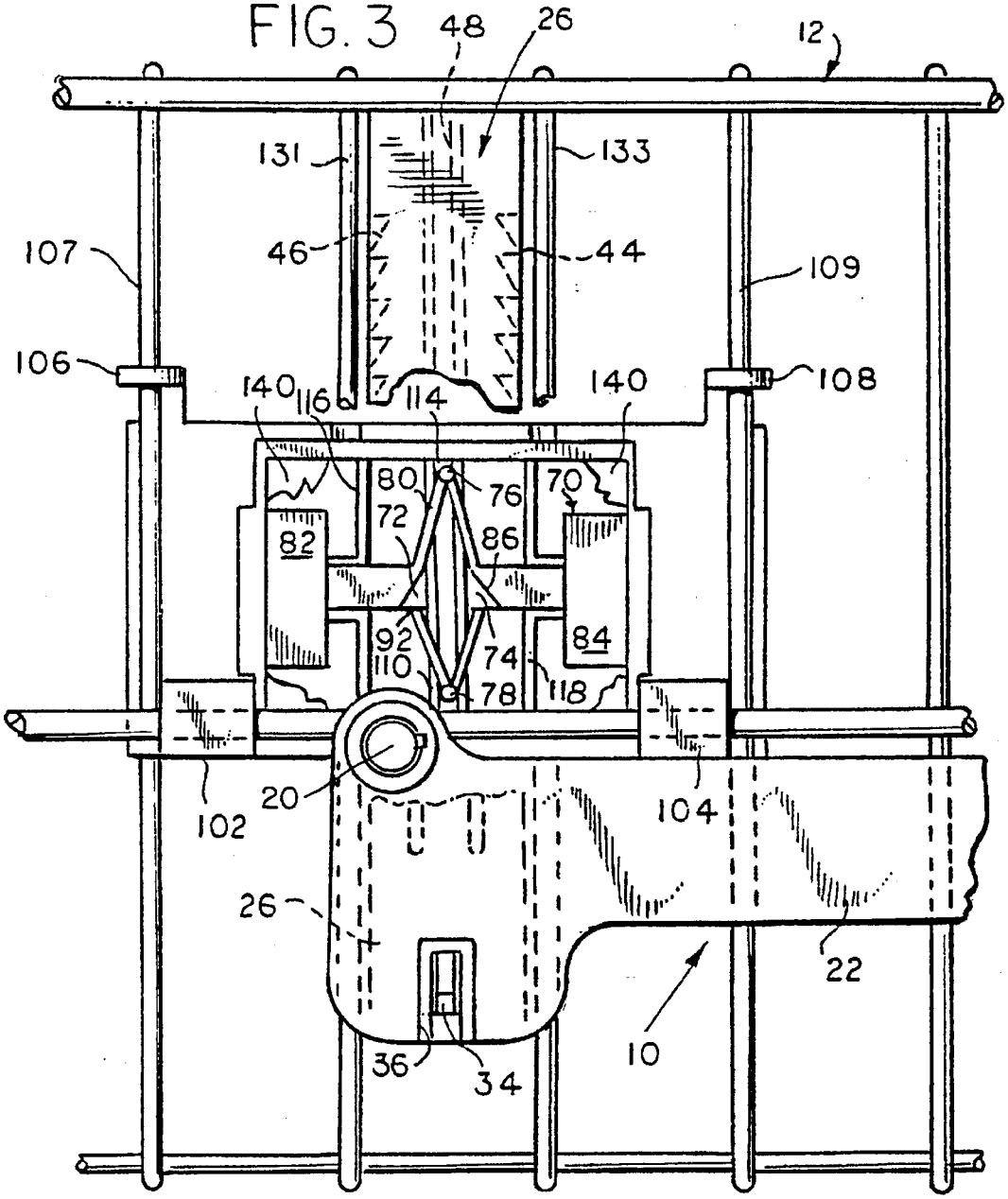
FIG. 3 is a side elevation, partially broken away, of the apparatus of FIGS. 1 and 2.

Each of the ratchet teeth 44, 46 and 72, 74 which comprise the locking means has a first, angled surface 86 and 88. These surfaces 86 and 88 are formed and oriented for slidable engagement as the actuator 70 is moved in an upward direction relative to the arm 26. Thus, when the actuator member 70 is moved upwardly, the sliding engagement between the respective pairs of angled surfaces 86, 88 of these ratchet teeth 44, 46, 72, 74 will cause the scissors spring 80 to collapse as shown in FIG. 3, allowing the ratchet teeth 72, 74 to pass over the ratchet teeth 44, 46. However, when an upward force is removed from the actuator 70, the scissors spring 80 will resiliently return to the position illustrated in FIG. 4 to cause opposite, generally horizontally disposed surfaces 90 and 92 of the respective ratchet teeth 44, 46 on the one hand and 72, 74 on the other hand to come into abutting contact, thus locking the actuator 70 against downward movement relative to the arm 26.

When these abutting surfaces 90 and 92 are engaged, the scissors spring 80 must be compressed by the application of force to one or both of the buttons 82, 84 in order to release the engagement between these abutting surfaces 90, 92 in order to permit the actuator 70 to be moved in a downward direction relative to the arm 26. It will be appreciated that with the guide pins 76, 78 both constrained to ride within the guide channel 48, depression of either of the buttons 82, 84 will cause the scissors spring 80 to contract and cause a mutual inward motion of the opposite one of the buttons 82, 84, as shown in FIG. 3.

Figure 13:
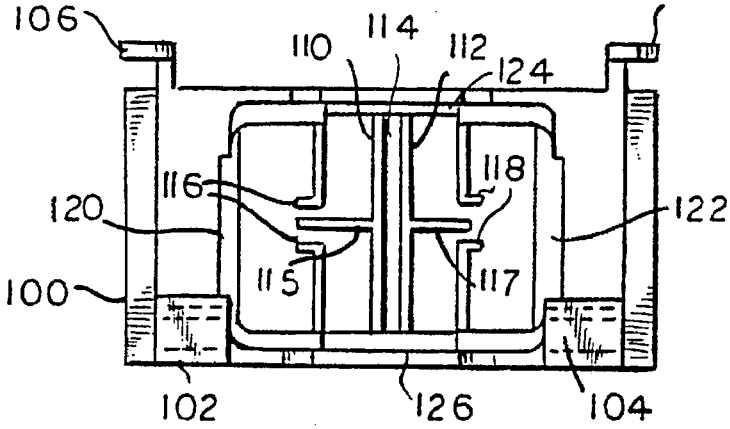
FIG. 13 is a side elevation of a housing member of the apparatus of the invention.
Figure 14:
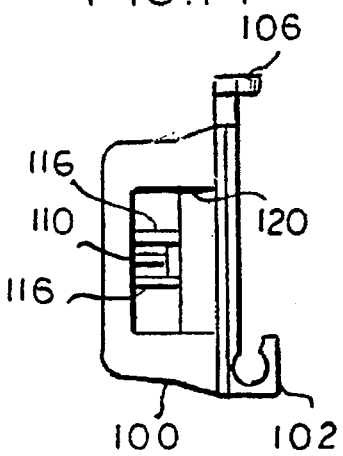
FIG. 14 is an end view of the housing member.
Figure 15:
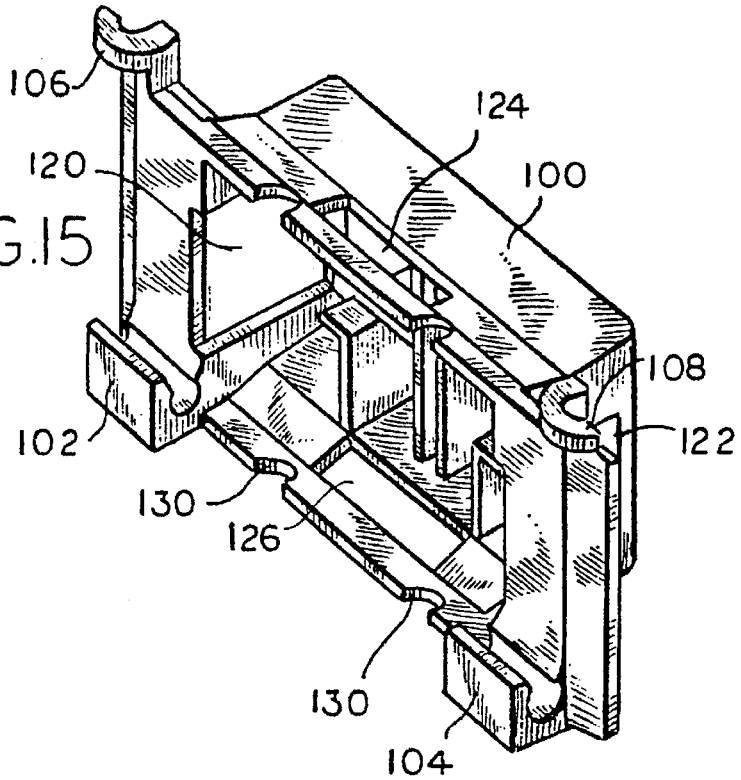
FIG. 15 is a perspective view of the housing member of FIG. 13.

Referring now also to FIGS. 13 through 15, a housing member 100 is provided. This housing member 100 is coupled with the rack 12 and is also operatively coupled with the actuator 70, to thereby cause the rack 12 to move reciprocally with the actuator 70, relative to the arm member 26. In order to couple the housing 100 to the rack 12, the housing 100 is provided with respective pairs of projecting hooks or hook-like members which are formed for engaging respective wires of the rack 12. A first pair 102, 104 of these hooks is formed in generally aligned, spaced apart locations on the housing 100 for snapping engagement with the same wire 105 of the rack 12 at two spaced apart locations along the length thereof. A second pair 106, 108 of these hooks or hook-like members projects outwardly from opposite sides of the housing 100 for engagement with a pair of spaced apart wires 107, 109 which are directed generally perpendicular to the wire 105 which is engaged by the first pair of hooks 102, 104.

The housing 100 has a first pair of internal ribs 110, 112 which define a guide channel 114. This guide channel 114 is generally aligned with and spaced from the guide channel 48 of the arm 26 when the housing is assembled with the arm. Cooperatively, the respective guide pins 76, 78 of the actuator 70 extend oppositely outwardly from their engagement with the guide channel 48 so as to also slidably engage the guide channel 114 of the housing 100. Further ribs 115, 117 also extend oppositely outwardly from midportions of ribs 110, 112 for further guiding and supporting the stems 83, 85, as they slide thereover. Additional pairs of generally L-shaped internal ribs 116, 118 form guides for slidably engaging and guiding the stem portions 83, 85 of the actuator 70, and also define stop surfaces for limiting the inward motion of the buttons 82, 84.

The housing 100 also has a first pair of opposed through apertures 120, 122 for slidably receiving the buttons 82, 84 therethrough. A second set of through apertures 124, 126 are aligned for receiving the upper portion 50 of the arm 26 therethrough and oriented in a generally perpendicular direction to the buttons 82, 84. The housing 100 is also provided with pairs of peripheral notches 130 for accommodating a further pair of wires 131, 133 of the rack 12 which are located intermediate the wires 107, 109.

Figure 16:
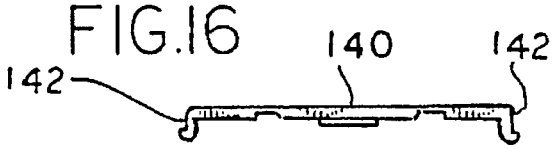
FIG. 16 is a top plan view of a cover member of the apparatus of the invention.
Figure 17:
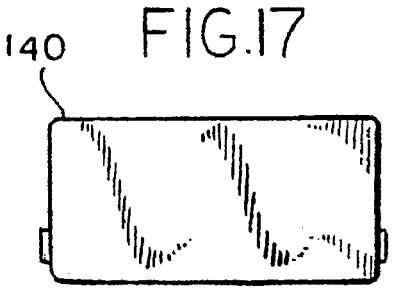
FIG. 17 is a side elevation of the cover member.

Referring briefly to FIGS. 16 and 17, a cover member 140 is illustrated. This cover member 140 is preferably assembled in overlying relation with the open face of the housing 100 generally between the arm 26 and the notches 130. The cover 140 may be provided with resilient locking tabs 142 at opposite edges thereof. The cover 140 is partially illustrated in FIGS. 3 and 4 in its assembled condition relative to the housing 100.

From the foregoing descriptions and the drawings, it will be appreciated that each of the constituent parts of the apparatus 10 is symmetrically configured, such that a like-configured apparatus 10 can be utilized upon both left-hand and right-hand sides of the rack 12.

While particular embodiments of the invention have been shown and described in detail, it will be obvious to those skilled in the art that changes and modifications of the present invention, in its various aspects, may be made without departing from the invention in its broader aspect, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim in the appended claims is to cover all such changes and modifications as fall within the true spirit and scope of the invention.

The invention is claimed as follows:

1. An adjustable position apparatus for selectively varying the position of a first member relative to a second member, comprising:

support means for supporting said first member relative to said second member;

elongated arm means mounted upon said support means and having a plurality of locking means disposed in a linearly spaced array thereon for defining a plurality of incremental positions;

guide means defined upon said arm means;

means having cooperating locking means of complementary form with respect to said locking means of said arm means;

actuating means for selectively moving said cooperating locking means into and out of engagement with said locking means of said arm means;

cooperating guide means engageable with said guide means of said arm means for guiding reciprocal longitudinal movements of said means, having said cooperating locking means, relative to said arm means; and housing means mounted upon said first member for operatively connecting said first member to said actuating means and said means, having said cooperating locking means, for facilitating movement of said first member with respect to said second member when said first member is to be adjusted relative to said arm means, said support means, and said second member as a result of actuation of said cooperating locking means, with respect to said locking means of said arm means, by said actuating means.

2. Apparatus according to claim 1, wherein:

said first member comprises opposite sides to be supported by said support means relative to said second member; and said support means is symmetrically formed such that it mountable upon said second member so as to be capable of supporting either one of said opposite sides of said first member by mounting one of said elongated arm means upon either one of said opposite sides of said first member wherein said elongated arm means, disposed upon said opposite sides of said first member, will be in alignment with respect to each other.

3. Apparatus according to claim 2, wherein:

said elongated arm means said actuating means, and said housing means are each symmetrical in form so as to be capable of being used upon either one of said opposite sides of said first member.

4. Apparatus according to claim 1, wherein:

said actuating means comprises spring means for biasing said cooperating locking means into releasable engagement with said locking means of said arm means; and said locking means and said cooperating locking means have first surfaces formed for slidable engagement with respect to each other when said means, having said cooperating locking means, is moved in a first direction relative to said arm means so as to momentarily overcome the biasing force of said spring means, and second surfaces formed for abutting engagement, such that said biasing force of said spring means must be overcome by an external force applied to said actuating means so as to release said engagement of said second surfaces and thereby permit vertical movement of said means, having said cooperating locking means, relative to said locking means of said arm means, in one of two opposite vertical directions such that said first member can be vertically adjusted with respect to said second member, said spring means being resiliently recoverable, following both said momentary overcoming of said biasing force by said slidable engagement of said first surfaces of said locking means and said cooperating locking means and cessation of the application of said external force to said actuating means, for returning said means, having said cooperative locking means, to a position at which said second surfaces of said locking means and said cooperative locking means are disposed in abutting engagement with each other.

5. Apparatus according to claim 1 wherein said locking means and said cooperating locking means comprise complementary sets of ratchet teeth.

6. Apparatus according to claim 5, wherein:

said actuating means comprises an outwardly projecting manually engageable button and a scissors spring operatively coupled with said button; and one of said complementary sets of ratchet teeth is located upon said means, having said cooperating locking means, for reciprocal movement into and out of engagement with the other one of said complementary sets of ratchet teeth in response to reciprocal movement of said button and said scissor spring.

7. Apparatus according to claim 1 wherein said locking means comprise two parallel, spaced apart, inwardly facing linear arrays of ratchet teeth and wherein said cooperating locking means comprise a pair of outwardly facing complementary ratchet teeth.

8. Apparatus according to claim 6 wherein said one of said sets of complementary ratchet teeth is mounted for movement in unison with said button, such that depressing said button disengages the complementary sets of ratchet teeth.

9. Apparatus according to claim 4 wherein said locking means and said cooperating locking means comprise complementary sets of ratchet teeth.

10. Apparatus according to claim 6 wherein said locking means comprise two parallel, spaced apart, inwardly facing linear arrays of ratchet teeth and wherein said cooperating locking means comprise a pair of oppositely outwardly projecting complementary ratchet teeth.

11. Apparatus according to claim 1, wherein:

said support means comprises an elongated member having spaced apart wheel mounting means thereon for receiving wheels for movably mounting said first member upon a track mounted upon said second member.

12. Apparatus according to claim 11, wherein:

said support member further comprises a pair of symmetrically spaced dovetail slots for respectively receiving said elongated arm means.

13. Apparatus according to claim 12 wherein said arm means includes a dovetail profile at one end thereof of complementary form for mounting within one of said dovetail slots.

14. Apparatus according to claim 1 wherein said housing means has a plurality of hook means projecting therefrom for snapping engagement with wires of a wire rack.

15. Apparatus according to claim 14 wherein said hook means comprise a first pair of spaced apart hooks aligned for engaging the same wire at spaced apart points therealong and a second pair of spaced apart hooks oriented perpendicular with respect to said first pair of hooks for engaging a pair of spaced apart wires oriented perpendicular to the wire engaged by said first pair of hooks.

16. Apparatus according to claim 6 wherein said guide means of said arm means define an elongate groove extending longitudinally of said arm means and wherein said cooperating guide means comprises a pair of guide pins projecting from respective apices of said scissors spring for sliding engagement with said elongate groove.

17. Apparatus according to claim 16 wherein said housing means include means defining an elongate groove and wherein said guide pins also project oppositely outwardly for engagement with said elongate groove of said housing means for aligning said housing means with said arm means, and such that depressing said button will cause said scissors spring to contract for disengaging the respective ratchet teeth of the means and the arm means.

18. Apparatus according to claim 1, wherein:

said actuating means comprises a pair of oppositely outwardly facing manually engageable buttons;

a scissors spring is disposed intermediate and joining said buttons;

said cooperating locking means comprises a ratchet tooth projecting from each one of said buttons; and said cooperating guide means comprises a pair of guide pins projecting outwardly from respective apices of said scissors spring.

19. Apparatus according to claim 1, wherein:

said arm means comprises an elongate member having a mounting portion at one end thereof configured for mounting upon a complementary mounting portion of said support means, and a projecting portion extending from said mounting portion and having said locking means disposed thereon which comprises a pair of spaced apart linearly arrayed sets of ratchet teeth.

20. Apparatus according to claim 1, wherein:

said housing means comprises a generally rectangular shell member having first guide means for accommodating said elongated arm means so as to permit said housing means to be moved bi-directionally along a first line with respect to said arm means, second guide means for accommodating said actuating means so as to permit said actuating means to be moved with respect to said housing in a bi-directional mode along a second line which is perpendicular to said first line, and outwardly projecting hook means for engaging wires of a wire rack.

21. Apparatus according to claim 20 wherein said hook means comprise a first pair of spaced apart hooks aligned for engaging the same wire at spaced apart points therealong and a second pair of spaced apart hooks oriented perpendicular with respect to said first pair of hooks for engaging a pair of spaced apart wires oriented perpendicular to the wire engaged by said first pair of hooks.

22. An actuator member for a height adjusting apparatus, comprising: a pair of oppositely outwardly facing manually engageable buttons; a pair of scissors springs intermediate and joining said buttons; a ratchet tooth projecting from each button, and a pair of guide pins projecting oppositely outwardly from respective apices of said scissors springs.

23. A housing member for an adjustable height apparatus, comprising:

a generally rectangular shell member having first guide means for accommodating support means upon which said housing member is to be mounted for bi-directional movement along a first line, second guide means for accommodating adjustment means to be mounted upon said housing for bi-directional movement along a second line which is perpendicular to said first line, and outwardly projecting hook means for engaging wires of a wire rack.

24. Apparatus according to claim 23 wherein said hook means comprise a first pair of spaced apart hooks aligned for engaging the same wire at spaced apart points therealong and a second pair of spaced apart hooks oriented perpendicular with respect to said first pair of hooks for engaging a pair of spaced apart wires oriented perpendicular to the wire engaged by said first pair of hooks.

25. An adjustable position apparatus for selectively varying the position of a first member relative to a second member, comprising:

a first housing mounted upon said first member;

a second housing mounted upon said second member;

support means, for movably supporting said first member upon said second member, movably disposed within said second housing of said second member;

elongated arm means mounted upon said support means and having a plurality of first locking means disposed in a linearly spaced array thereon for defining a plurality of incremental positions to which said first member may be adjusted with respect to said second member;

second locking means mounted upon said first housing for operatively cooperating with said plurality of first locking means provided upon said arm means so as to maintain said first member at a particularly desired adjusted position with respect to said second member when said second locking means is engaged with a particular one of said plurality of first locking means defining said plurality of incremental positions;

first guide means defined upon said arm means;

second guide means provided upon said first housing for operatively cooperating with said first guide means of said arm means so as to guide movements of said second locking means of said first housing with respect to said first locking means of said arm means when said first housing and said first member are moved with respect to said second member so as to positionally adjust the disposition of said first member with respect to said second member; and actuating means mounted upon said first housing and operatively connected to said second locking means for selectively moving said second locking means of said first housing into and out of engagement with said first locking means of said arm means when said first member is to be moved with respect to said second member so as to positionally adjust the disposition of said first member with respect to said second member.

26. An adjustable position apparatus for selectively varying the elevational position of a dishwasher rack relative to a dishwasher cabinet, comprising:

a first housing mounted upon said dishwasher rack;

a second housing mounted upon a wall portion of said dishwasher cabinet;

support means, for movably supporting said dishwasher rack upon said dishwasher cabinet, movably disposed within said second housing of said wall portion of said dishwasher cabinet;

elongated arm means mounted upon said support means and having a plurality of first locking means disposed in a linearly spaced array thereon for defining a plurality of incremental positions to which said dishwasher rack may be adjusted with respect to said dishwasher cabinet;

second locking means mounted upon said first housing for operatively cooperating with said plurality of first locking means provided upon said arm means so as to maintain said dishwasher rack at a particlarly desired adjusted position with respect to said dishwasher cabinet when said second locking means is engaged with a particular one of said plurality of first locking means defining said plurality of incremental positions;

first guide means provided upon said arm means;

second guide means provided upon said first housing for operatively cooperating with said first guide means of said arm means so as to guide movements of said second locking means of said first housing with respect to said first locking means of said arm means when said first housing and said dishwasher rack are moved with respect to said dishwasher cabinet so as to positionally adjust the disposition of said dishwasher rack with respect to said dishwasher cabinet; and actuating means mounted upon said first housing and operatively connected to said second locking means for selectively moving said second locking means of said first housing into and out of engagement with said first locking means of said arm means when said dishwasher rack is to be moved with respect to said dishwasher cabinet so as to positionally adjust the disposition of said dishwasher rack with respect to s&id dishwasher cabinet.

* * * * *